US006338483B1

(12) United States Patent
Andela et al.

(10) Patent No.: US 6,338,483 B1
(45) Date of Patent: Jan. 15, 2002

(54) SINGLE SHEET FEEDER WITH SELECTIVELY ENGAGEABLE PREFEEDING ROLLS

(76) Inventors: Jeffrey L. Andela, *deceased*, late of Williamson, NY (US); by Christine R. DeFisher(Andela), *representative*, 5598 Pease Rd., Williamson, NY (US) 14598

( * ) Notice: Subject to any disclaimer, the term of this patent is extended or adjusted under 35 U.S.C. 154(b) by 0 days.

(21) Appl. No.: 09/448,417

(22) Filed: Nov. 23, 1999

(51) Int. Cl.[7] ..... B65H 7/02

(52) U.S. Cl. ..... 271/227; 271/188; 271/250; 271/265.01; 271/273

(58) Field of Search ..... 271/227, 228, 271/250, 251, 252, 258.01, 265.01, 273, 188

(56) References Cited

U.S. PATENT DOCUMENTS

| | | | | |
|---|---|---|---|---|
| 4,019,025 A | * | 4/1977 | Taniguchi et al. | 271/273 |
| 4,428,667 A | | 1/1984 | Phelps et al. | |
| 5,090,683 A | | 2/1992 | Kamath et al. | |
| 5,169,140 A | | 12/1992 | Wenthe, Jr. | |
| 5,253,862 A | * | 10/1993 | Acguaviva et al. | 271/251 |
| 5,278,624 A | | 1/1994 | Kamprath et al. | |
| 5,601,283 A | | 2/1997 | Pinckney | |
| 5,678,159 A | | 10/1997 | Williams et al. | |
| 5,681,036 A | * | 10/1997 | Wakabara et al. | 271/227 |
| 5,887,996 A | | 3/1999 | Castelli et al. | |
| 6,164,643 A | * | 12/2000 | Otsuka | 271/250 |
| 6,168,153 B1 | * | 1/2001 | Richards et al. | 271/227 |

FOREIGN PATENT DOCUMENTS

| | | | | |
|---|---|---|---|---|
| JP | 0176249 | * | 7/1988 | 271/251 |
| JP | 404323134 A | * | 11/1992 | 271/228 |

* cited by examiner

*Primary Examiner*—H. Grant Skaggs
(74) *Attorney, Agent, or Firm*—Oliff & Berridge, PLC

(57) ABSTRACT

A sheet feeder assembly includes a self-actuating prefeed roll located upstream of a deskewing device, which can include a document sensor switch and a deskew nip roll. After a sheet has been detected at the input of the assembly, a limited slip clutch causes the prefeed nip to close. The prefeed device selectively engages the sheet based on detection of the sheet at the input and then disengages upon detection of the sheet at the deskewing device. Thus, there are no obstructions at the input that the sheet must pass before engagement by the prefeed assembly. By this, chances of misfeeding a sheet that has not been sufficiently pushed into the document feeder are greatly reduced. Moreover, the assembly has increased latitude in the positioning of the input sheet and is particularly desirable for light weight documents since no obstructions exist within the paper path. Such an assembly is very user friendly because the machine reacts to the presence of a sheet and does not rely on the operator to push the sheet completely into the feeding assembly.

25 Claims, 4 Drawing Sheets

SINGLE SHEET FEEDER WITH SELECTIVELY ENGAGEABLE PREFEEDING ROLLS

BACKGROUND OF THE INVENTION

1. Field of Invention

This invention relates to sheet feeding assemblies. In particular, this invention relates to feeding assemblies that control sheet registration and orientation.

2. Description of Related Art

Reproduction apparatuses must control sheet feeding to ensure that the original document sheet is fed in a straight, properly positioned manner to achieve accurate reproduction of the original document. Such reproduction apparatuses include copiers, scanners and facsimile machines, for example. It is also critical to feed a sheet accurately and in an aligned manner to prevent jamming of the sheet in the feed path.

There are many known sheet registration assemblies, commonly referred to as deskewing devices, that control feeding and correct misalignment. One example is U.S. Pat. No. 5,090,683 to Kamath et al. in which a sheet is initially fed to input drive rollers that convey the sheet to detectors that detect the leading edge of the sheet to signal the controller of the presence of the sheet in the assembly. Another example is U.S. Pat. No. 5,169,140 in which a sheet is initially driven with an undetected amount of skew to skew detectors and then driven differentially to deskew the sheet based on signals from the skew detectors.

An example of a sheet registration and deskewing device in use in an electrophotographic printing machine is shown in U.S. Pat. No. 5,678,159 to Williams et al and in U.S. Pat. No. 5,887,996 to Castelli. An example of use of a document deskewing system in a copier is shown in U.S. Pat. No. 4,428,667 to Phelps et al.

The above devices, however, engage and drive the sheet into the feed path before detection of the sheet. Thus, the sheet must be fed into the nip of the drive assembly prior to actuating the system, especially the deskewing system. This creates obstacles in the feed path that can create problems or require additional attention from the user. Many lightweight documents experience jamming or wrinkling when passing obstacles in the feed path. Also, the drive rolls that nip the sheet to activate the system constrict the latitude of possible sheet orientation upon input and requires greater care by the user. A system without initial obstacles that enabled easy use by all users would be desirable.

SUMMARY OF THE INVENTION

An aspect of this invention is to provide a feeding assembly that easily feeds sheets to a feed path with a high degree of accuracy.

Another aspect of this invention is to provide an assembly that has a user-friendly feel when a sheet is input to the device. Further, this invention allows a greater latitude in document input and registration during input to facilitate operation by a user.

An additional aspect to this invention is to provide an assembly that functions well with a full range of document weights.

A sheet feeding assembly according to the invention is used for feeding a sheet to a feed path. The assembly comprises a sheet input with a sheet detector that outputs a signal when a sheet is present at the input. A prefeeding mechanism is provided that is selectively engageable with the sheet at the input. A deskewing mechanism is disposed downstream of the prefeeding mechanism and controls orientation of the sheet. A controller is coupled to the sheet detector, the prefeeding mechanism and the deskewing mechanism to actuate the deskewing mechanism in response to the signal from the sheet detector and selectively engage the sheet with the prefeeding mechanism to drive the sheet to the deskewing mechanism.

The sheet feeding assembly can further comprise a limited slip clutch connected to the deskewing mechanism to cause the prefeeding mechanism to respond to the signal output from the sheet detector by moving the prefeeding mechanism toward the input. A sensor can be provided in proximity to the deskewing mechanism that detects a leading edge of the sheet to cause the prefeeding mechanism to disengage with the sheet upon a signal from the sensor.

The method of controlling a sheet feeding assembly to feed a sheet from an input to a feed path according to this invention comprises the steps of detecting the sheet at the input, actuating a driving apparatus, moving a prefeeding driving mechanism with the driving apparatus to engage the sheet, and manipulating the sheet with a deskewing apparatus to deskew the sheet with respect to the feed path.

The method can include actuating the driving apparatus with a limited slip clutch in response to detecting a sheet in the feed path to pivot the prefeeding driving mechanism toward a nip roll to engage the sheet. The method can also include automatically biasing the prefeeding driving mechanism away from the input when a sheet is not detected at the input and detecting a leading edge of the sheet within the feed path at the deskewing mechanism to disengage the prefeeding driving mechanism.

The invention also encompasses a reproduction assembly comprising an image reproduction device for reproducing images from an original document sheet. A sheet feed path extends from an input to an output past the image reproduction device. A self-actuating prefeeding device selectively engages a sheet at the input and drives the sheet into the feed path, and a controller controls engagement of the self-actuating prefeeding device based on presence of a sheet at the input of the feed path.

The reproduction assembly can further comprise a deskewing device located in the feed path downstream of the self-actuating prefeeding device for controlling orientation of the original document sheet being fed through the feed path. A sheet detector and a movable nip assembly may also be provided, wherein the deskewing device actuates the movable nip assembly to move into the feed path to engage a sheet at the input based on a signal from the sheet detector.

Other aspects, advantages and salient features of the invention will be become apparent from the following detailed description, which taken in conjunction with the drawings discloses preferred embodiments of the invention.

BRIEF DESCRIPTION OF THE DRAWINGS

Referring to the drawings which form a part of this disclosure.

DETAILED DESCRIPTION OF PREFERRED EMBODIMENTS

The feeding assembly described herein is discussed in the context of a reproduction assembly, such as a copier, for purposes of illustration. However, the feeding assembly could be implemented in any type of reproduction apparatus, such as a printer, facsimile machine or scanner, or any device that feeds sheet material through a feed path.

Figure 1:
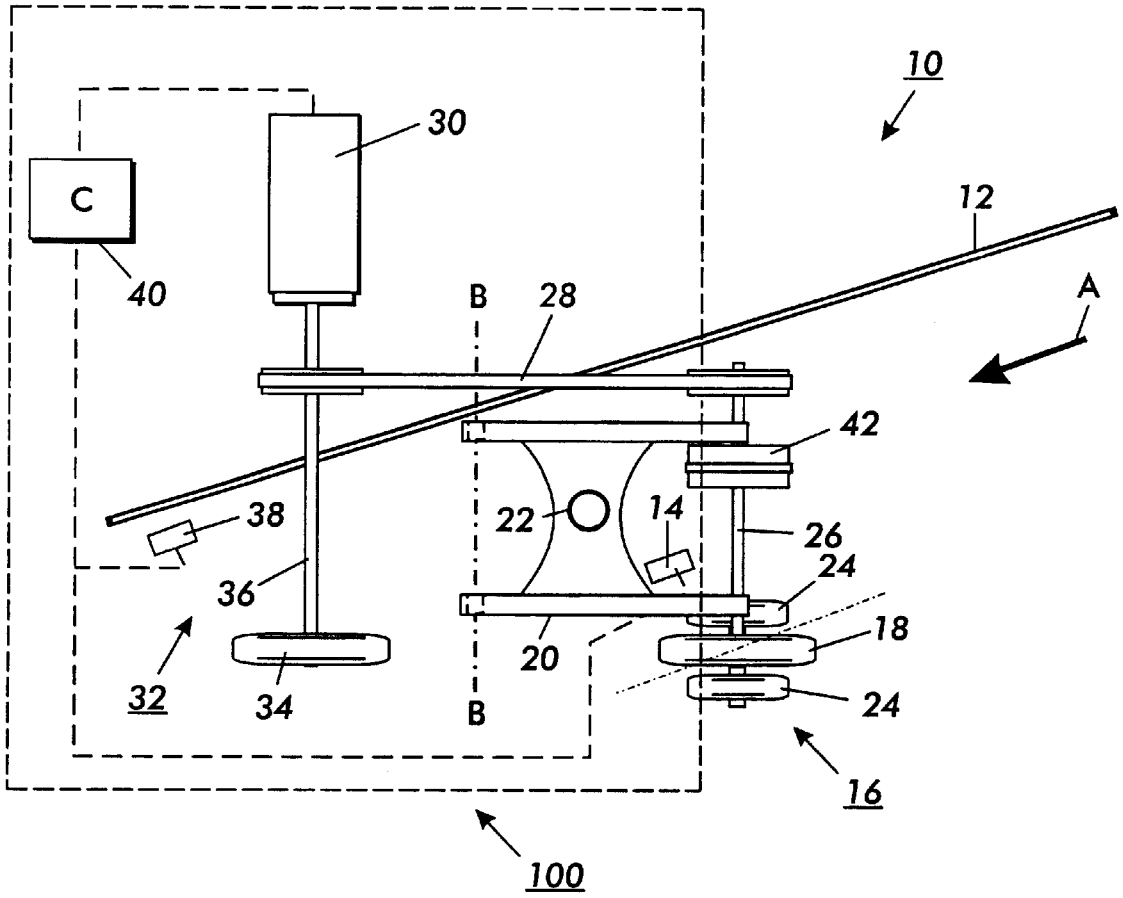
FIG. 1 is a schematic bottom view of the prefeeding and deskewing assembly according to this invention.

FIG. 1 shows a feeding assembly 10 in accordance with this invention in a schematic overview as seen from the bottom of the assembly. The assembly is positioned at the input of a reproduction device 100 and includes a feed path indicated by arrow A. A registration guide 12 is provided at one edge of the feed path and extends in the direction of arrow A. A sheet detector 14, in the form of a sensor switch, is located at the input. Sheet detector may be any type of sensor, such as a pivotal lever that is mechanically actuated by insertion of a sheet or an optical sensor that actuates when the optical path is obstructed, for example. A prefeeding mechanism 16 is positioned at the input adjacent to sheet detector 14.

Figure 3:
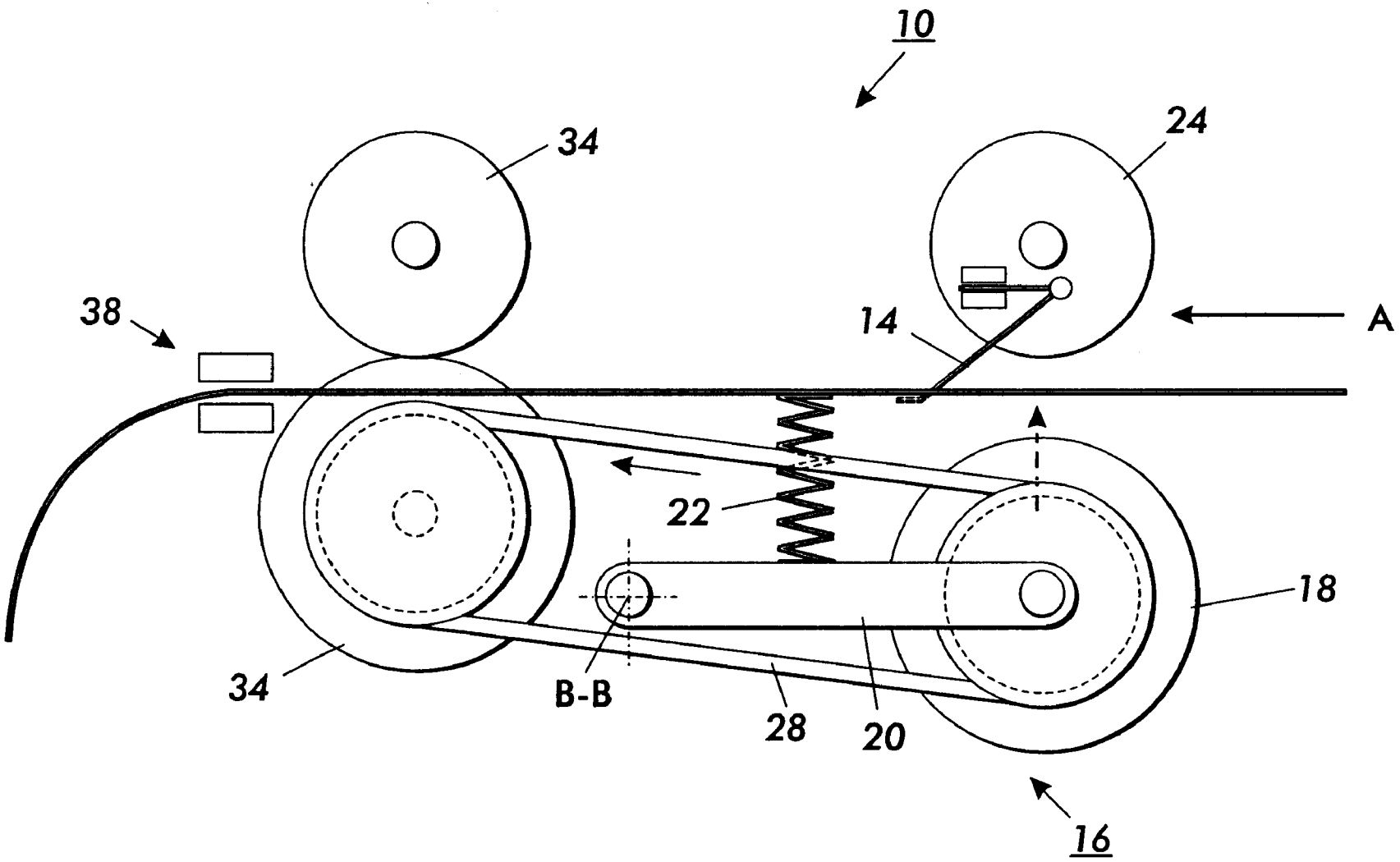
FIG. 3 is a schematic side view of the assembly shown in FIG. 1 prior to insertion of a sheet.
Figure 4:
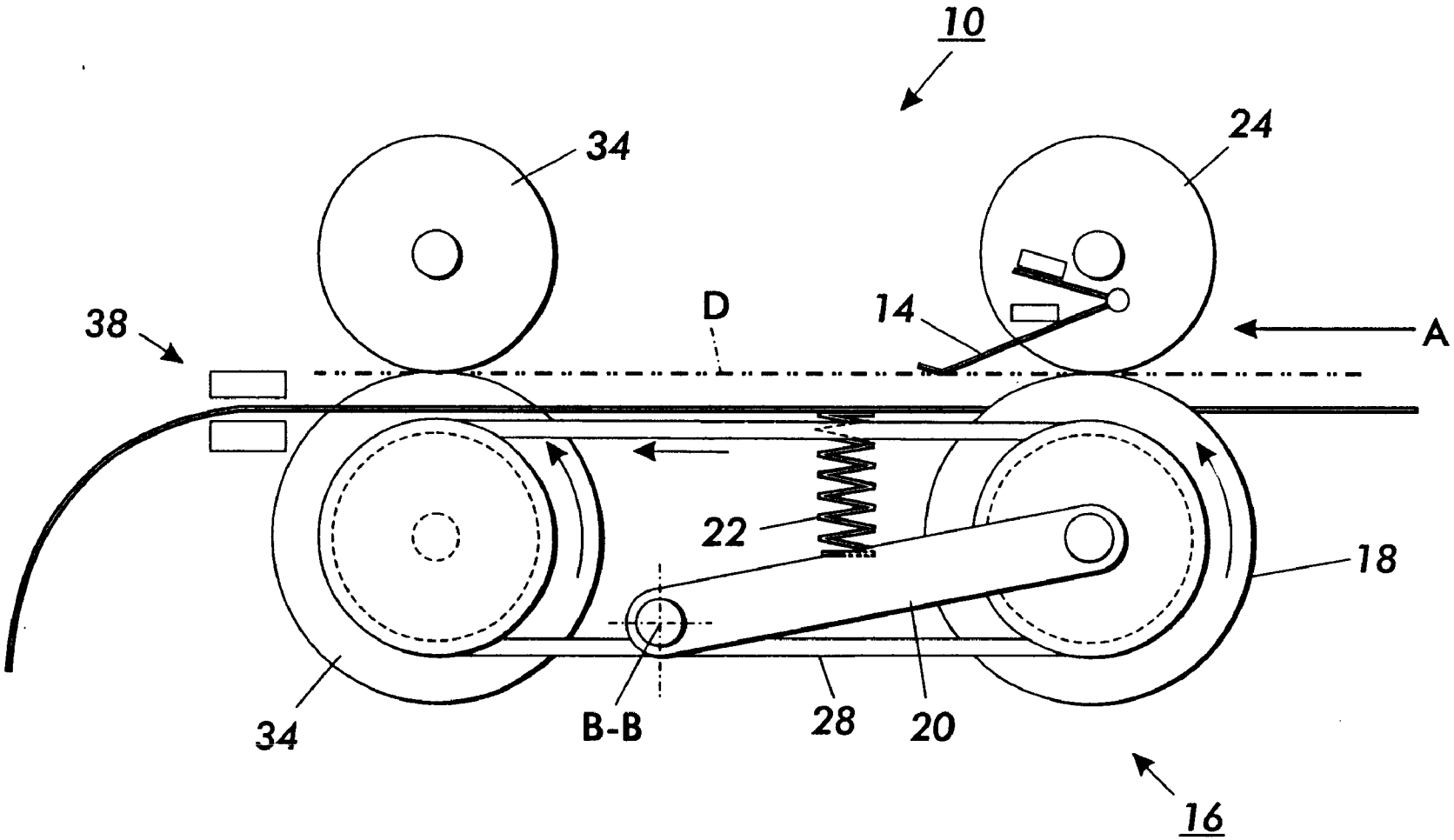
FIG. 4 is a schematic side view of the assembly shown in FIG. 1 after insertion of a sheet.

Prefeeding mechanism 16 includes at least one prefeed roll 18, also called a nudger roll, supported on a prefeed roll pivot frame 20. Any number or type of rolls 18 can be used depending on the intended use of the assembly and the preferred material to be fed into the device. Frame 20 pivots about pivot axis B—B. A biasing mechanism 22, such as a return spring as shown in FIGS. 3 and 4, is positioned to abut frame 20 and normally bias frame 20 away from feed path A. Biasing mechanism 22 is shown as a helical spring, but could be embodied as any type of biasing mechanism such as a leaf spring or resilient fastener. It is also possible to eliminate biasing mechanism 22 and use a drive mechanism to move frame 20 away from feed path A when disengagement of prefeeding mechanism 16 is desired.

A pair of corrugating rolls 24 can be provided opposed to prefeed roll 18 to pinch the sheet upon engagement of prefeeding mechanism 16 with feed path A. As known, corrugating rolls 24 serve to corrugate or create ridges in the sheet to impart beam strength to the sheet to facilitate feeding. Of course, any type of nip assembly could be used, such as a friction roll, to drive the sheet into the assembly.

Prefeed roll 18 is carried by a drive shaft 26 that is coupled to a drive shaft 28, such as an O-ring drive, which is in turn coupled to a drive 30. A deskewing mechanism 32 is connected to drive 30 and preferably comprises a deskew roll 34 supported by a drive shaft 36. However, any suitable deskewing mechanism 32 can be employed to control the orientation of a sheet in the feed path, including a combination of rolls that are selectively controlled with respect to velocity and lateral position. Examples of known deskewing mechanisms are disclosed in U.S. Pat. No. 5,601,283 to Pinckney and U.S. Pat. No. 5,278,624 to Kamprath et al., which are both incorporated herein by reference.

A movement translating mechanism 42, preferably in the form of a limited slip clutch, is connected to prefeeding mechanism 16 to convey drive movement from drive 30 through O-ring drive 28 to drive shaft 26 to pivot frame 20. By this, frame 20 is moved into position in feed path A when drive 30 is actuated. Any type of mechanism that creates a torque reaction against a drag clutch to translate the drive force from drive 30 to prefeeding mechanism 16 would be suitable.

A sensor 38 is provided adjacent to deskewing mechanism 32 in feed path A to detect a leading edge of the sheet being fed through the feed path. As discussed below, sensor 38 generates a signal used to deactivate or disengage prefeeding mechanism 16 when the sheet is being or has been deskewed.

A controller 40 is provided to control drive 30 based on signals from sheet detector 14 and sensor 38. Controller 40 may be preprogrammed or selectively programmable depending on desired implementation of the feeding assembly. Preferably, controller 40 operates by one or more control programs. Such a control program is preferably implemented on a programmed general purpose computer. However, the control program can also be implemented on a special purpose computer, a programmed microprocessor or microcontroller and peripheral integrated circuit elements, in an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing the process shown in FIG. 2 described below, can be used to implement the control program. The control program is preferably recorded on a storage medium, which can be embodied in any medium capable of storing a control program, including but not limited to a hard drive, a conventional floppy disk, compact disk or chip.

Figure 2:
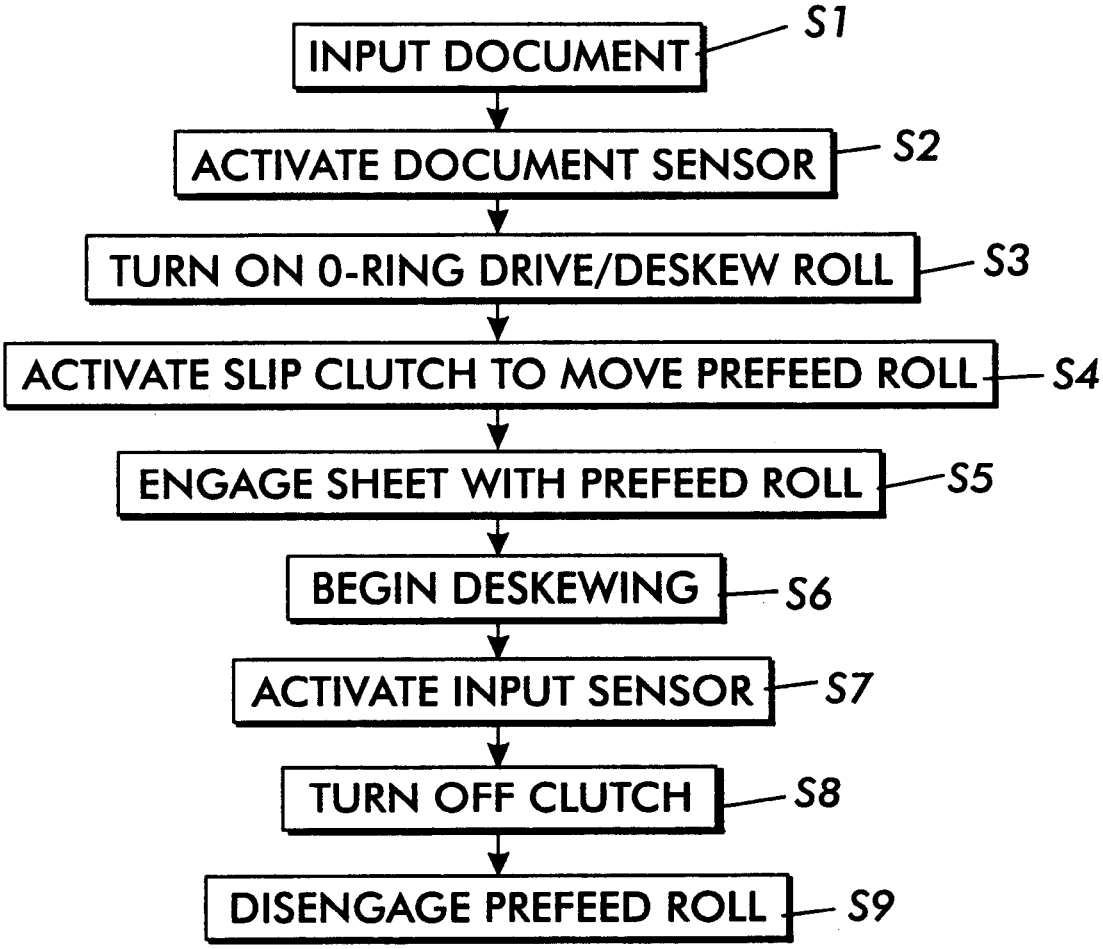
FIG. 2 is a flowchart describing the operation of the device in accordance with this invention.

FIG. 2 illustrates the main process steps in accordance with this invention. In the following description, the various steps are represented by the reference symbol S. In operation, a document sheet D is introduced to the machine at the input of feed path A at S1. Prior to introduction of document sheet D, the assembly is at rest in the position shown in FIG. 3 with prefeeding mechanism 16 spaced from feed path A, with frame 20 naturally biased by spring 22. As seen in FIG. 3, there are no obstructions such as feeding rolls or sheet registration guides at the input in this position.

When document sheet D is input, sheet detector 14 is activated at S2. Sheet detector sends a signal to controller 40 to start drive 30, which drives O-ring drive 28 and deskewing mechanism 32 at S3. As seen in FIG. 3, roll 34 rotates, which causes O-ring drive 28 to rotate and clutch 42 to actuate. O-ring drive 28 causes drive shaft 26 to rotate. With clutch 42 actuated at S4, the torque reaction against limited slip clutch 42 by O-ring drive 28 compresses return spring 22. This causes prefeed roll 28 to engage the opposed corrugating rolls 24 and create a nip through which document sheet D is fed at S5. At S6, deskewing begins with document sheet D fed to deskew rolls 34.

When document sheet D advances to sensor 38, a signal is sent to controller 40 at S7 when the leading edge of document sheet D is detected. The clutch turns off at S8, which disengages prefeed roll 18 at S9.

The exact timing can be optimized for best deskew/sheet feed effect and may be customized for each particular machine depending on the particular intended usage. Also, the precise positioning and spacing of the elements can be varied based on the particular application. As shown in FIG. 1, prefeed roll 18 is spaced inward of registration guide 12 and before or upstream of the deskew roll 34. For example, in one test device, the position of the prefeed roll was approximately 2.5" from the registration guide and approximately 2.5" from the deskew roll.

Using corrugating rolls 24, the beam strength of document sheet D provides the drive force. Therefore, a broad range of paper weights can be fed without slip or damage when using such a corrugating input.

As can be appreciated from the operation described above, use of the prefeed/deskew action allows for even more inaccuracy in document placement for sheet acquisition, since prefeed roll 18 retracts after each prefeed. Therefore, there is no obstruction for a document sheet to overcome to be successfully handled.

While advantageous embodiments have been chosen to illustrate the invention, it will be understood by those skilled in the art that various changes and modifications can be made therein without departing from the scope of the invention as set forth in the appended claims.

What is claimed is:

1. A sheet feeding assembly for feeding a sheet to a feed path, comprising:

a sheet input with a sheet detector that outputs a signal when a sheet is present at the input;

a prefeeding mechanism selectively engageable with the sheet at the input;

a deskewing mechanism disposed downstream of the prefeeding mechanism that controls orientation of the sheet; and a controller coupled to the sheet detector, the prefeeding mechanism and the deskewing mechanism to actuate the deskewing mechanism in response to the signal from the sheet detector and selectively engage the sheet with the prefeeding mechanism to drive the sheet to the deskewing mechanism.

2. The sheet feeding assembly of claim 1, further comprising a limited slip clutch connected to the deskewing mechanism to cause the prefeeding mechanism to respond to the signal output from the sheet detector.

3. The sheet feeding assembly of claim 2, wherein the deskewing mechanism includes a drive that actuates the slip clutch to move the prefeeding mechanism with respect to the input.

4. The sheet feeding assembly of claim 1, further comprising a sensor that detects a leading edge of the sheet disposed in proximity to the deskewing mechanism.

5. The sheet feeding assembly of claim 4, wherein the sensor is coupled to the controller and the controller causes the prefeeding mechanism to disengage with the sheet upon a signal from the sensor.

6. The sheet feeding assembly of claim 1, further comprising a nip roll opposed to the prefeeding mechanism that is selectively engaged by the prefeeding mechanism when a sheet is detected at the input to drive the sheet to the deskewing mechanism.

7. The sheet feeding assembly of claim 6, wherein the nip roll is a corrugating roll.

8. The sheet feeding assembly of claim 1, further comprising a sheet corrugating device disposed at the input.

9. The sheet feeding assembly of claim 1, wherein the prefeeding mechanism is pivotally supported to move toward and away from the input based on instructions from the controller.

10. The sheet feeding assembly of claim 1, wherein the prefeeding mechanism includes a driven roll supported on a movable frame.

11. The sheet feeding assembly of claim 1, further comprising a biasing member coupled to the prefeeding mechanism that tends to bias the prefeeding mechanism away from the input.

12. The sheet feeding assembly of claim 1, wherein the deskewing mechanism includes at least one deskewing roll coupled to a driver.

13. The sheet feeding assembly of claim 1 in combination with an image reproduction machine.

14. A method of controlling a sheet feeding assembly to feed a sheet from an input to a feed path, comprising the steps of:

detecting presence of the sheet at the input;

actuating a driving apparatus;

moving a prefeeding driving mechanism with the driving apparatus to engage the sheet after detecting the presence of the sheet at the input; and manipulating the sheet with a deskewing apparatus to deskew the sheet with respect to the feed path.

15. The method of claim 14, wherein the step of actuating the driving apparatus includes actuating a limited slip clutch.

16. The method of claim 15, wherein the limited slip clutch is actuated in response to detecting a sheet in the feed path.

17. The method of claim 14, wherein the step of moving the prefeeding driving mechanism includes pivoting the prefeeding driving mechanism toward a nip roll.

18. The method of claim 14, further comprising automatically biasing the prefeeding driving mechanism away from the input when a sheet is not detected at the input.

19. The method of claim 14, further comprising:

detecting a leading edge of the sheet within the feed path; and disengaging the prefeeding driving mechanism based on the detection.

20. The method of claim 19, further comprising automatically biasing the prefeeding driving mechanism away from the input to disengage the prefeeding driving mechanism when the leading edge of the sheet is detected.

21. The method of claim 14, further comprising corrugating the sheet with the prefeeding driving mechanism.

22. A reproduction assembly, comprising:

an image reproduction device for reproducing images from an original document sheet;

a sheet feed path extending from an input to an output past the image reproduction device;

a self-actuating prefeeding device that selectively engages a sheet at the input and drives the sheet into the feed path;

a deskewing device located in the feed path downstream of the self-actuating prefeeding device for controlling orientation of the original document sheet being fed through the feed path; and a controller connected to the self-actuating prefeeding device that controls engagement of the self-actuating prefeeding device based on presence of a sheet at the input of the feed path and presence of a sheet at a position in the feed path adjacent to the deskewing device.

23. The reproduction assembly of claim 22, wherein the self-actuating prefeeding device includes a sheet detector and a movable nip assembly, wherein the deskewing device actuates the movable nip assembly to move into the feed path to engage a sheet at the input based on a signal from the sheet detector.

24. The reproduction assembly of claim 23, further comprising a limited slip clutch coupled between the deskewing device and the movable nip assembly that moves the movable nip assembly into the feed path with drive movement from the deskewing device.

25. The reproduction assembly of claim 22, wherein the self-actuating prefeeding device includes a sheet detector connected to the controller and a movable nip assembly, wherein the controller actuates the movable nip assembly to move into the feed path to engage a sheet at the input based on a signal from the sheet detector.

* * * * *